US005130750A

United States Patent [19]

Rabb

[11] Patent Number: 5,130,750

[45] Date of Patent: Jul. 14, 1992

[54] CROSS-PITCH SCHEDULING OF DOCUMENTS AND COPY SHEETS IN A COPY SYSTEM

[75] Inventor: Khalid M. Rabb, Webster, N.Y.

[73] Assignee: Xerox Corporation, Stamford, Conn.

[21] Appl. No.: 632,073

[22] Filed: Dec. 21, 1990

[51] Int. Cl.[5] ..... G03G 21/00

[52] U.S. Cl. ..... 355/208; 355/204; 355/316

[58] Field of Search ..... 355/204, 208, 316, 200, 355/308, 309, 317; 271/9

[56] References Cited

U.S. PATENT DOCUMENTS

| | | | |
|---|---|---|---|
| 3,840,222 | 10/1974 | Fowlie et al. | 355/309 X |
| 3,917,396 | 11/1975 | Donohue et al. | 355/204 |
| 4,026,647 | 5/1977 | Kanno et al. | 355/317 X |
| 4,270,860 | 6/1981 | Tsuda et al. | 355/200 |
| 4,416,534 | 11/1983 | Kluger | 355/317 |
| 4,588,284 | 5/1986 | Federico et al. | 355/308 X |
| 4,589,645 | 5/1986 | Tracy | 271/3.1 |
| 4,800,482 | 1/1989 | Hosaka et al. | 355/308 X |
| 4,816,868 | 3/1989 | Shimizu et al. | 355/200 |
| 4,924,265 | 5/1990 | Partilla et al. | 355/204 |
| 4,939,554 | 7/1990 | Hirabayashi et al. | 355/317 |
| 4,961,092 | 10/1990 | Rabb et al. | 355/318 X |

*Primary Examiner*—A. T. Grimley
*Assistant Examiner*—Robert Beatty
*Attorney, Agent, or Firm*—Oliff & Berridge

[57] ABSTRACT

A copy machine schedules a copy sheet for being fed by a copy sheet feed system from a supply to a transfer station to have an image copied from an original document to the copy sheet after that original document is scheduled for being imaged by an imaging system. Usually, the scheduling of the copy sheet feed system is delayed until the following pitch, and thus the scheduling of the copy sheet feed system occurs in a different pitch than the scheduling of the imaging system for a particular document. This delay permits the end-of-set signal to be generated if that document is the last document in a stack of documents to be copied prior to scheduling the copy sheet which is to receive a copy of the image contained on that last document. Thus, the control hierarchy of the copy machine is able to use the knowledge that a document is a last document in a set of documents to accurately control components of the copy machine (e.g., to select a proper type of copy sheet and/or offset copy sheet output) without skipping pitches or precounting the documents in the stack.

10 Claims, 9 Drawing Sheets

CROSS-PITCH SCHEDULING OF DOCUMENTS AND COPY SHEETS IN A COPY SYSTEM

BACKGROUND OF THE INVENTION

1. Field of the Invention

The present invention relates to an electronic control and, in particular, to an improved control for a copy system wherein documents are scheduled (i.e., components of the copy system are instructed when to perform specified functions relating to that document) at a time which is separate from the time at which a copy sheet which is to receive the image contained on the document is scheduled (i.e., components of the copy system are instructed when to perform specified functions relating to that copy sheet).

2. Discussion of Related Art

Copy machines typically provide a photoconductive belt or drum (hereafter referred to only as a belt) which is rotated and receives a latent image of one or more original documents thereon. The latent image can be formed on the photoconductive belt by directing a stream of light which is modulated according to the image contained on an original document towards the photoconductive belt. This stream of light can be formed, for example, by reflecting a beam of light off of the original document and onto the photoconductive belt, or by scanning the document with an electronic scanner to produce a data signal and converting the data signal to a light signal (e.g., an imagewise modulated laser beam) which is then directed to the photoconductive belt. Alternatively, a stream of ions can be directed towards an electroreceptive surface (contained, for example, on a belt or drum) so as, to imagewise charge the electroreceptive surface and form a latent image thereon. These various fashions of forming a latent image on a surface, such as a photoreceptive or electroreceptive surface, from an original document are generally referred to as "imaging" that document.

In a copy machine, the photo or electroconductive belt or drum (hereinafter referred to merely as a photoconductive belt) is often divided into "pitches". Each pitch represents one image at various stages of the reproduction process. Usually, there are more than one image or pitch on the belt at any one time. In the control of the copy machine, therefore, to time various events related to various pitches, it is necessary to track according to each pitch the time that a particular event should occur in relation to that particular pitch. This is done by timed clock signals related to each pitch in order to synchronize the events of the machine and coordinate the various events. See, for example, U.S. Pat. No. 4,588,284 to Federico et al.

The terminology "scheduling" refers generally to the process of instructing one or more components (or subsystems) of the copy machine when to perform one or more specified functions related to an original document to be copied (hereafter referred to as a document) and/or to a sheet which is to receive the image contained on that document (hereafter referred to as a copy sheet). Thus, "scheduling" involves instructing a component of a copy system at what time, relative to a reference time, that component is to perform its specified function. Typically, some point along the circumference of the belt acts as a reference point (usually falling between consecutive pitches) from which all events are to occur. For example, the time at which this reference point is located at a certain position in the copy machine is designated as a reference time, and the time at which various events are to occur are designated relative to this reference time. Since the belt is moved at a substantially constant velocity, the location of any particular portion (or pitch) of the belt can be continuously tracked by a main controller (or Job Manager) which oversees the functioning of all the components of the copy machine.

The Job Manager instructs each of the components of the copy machine when to perform its respective function relative to each document to be imaged, and relative to each copy sheet which is to receive an image from a respective document so that the images contained on consecutive documents are output onto consecutive copy sheets. In other words, the Job Manager instructs the imaging system when to image a document placed on a platen of the copy machine so as to produce an image signal representative of the image contained on that document and to project that signal onto a pitch of the photoconductive belt. The Job Manager also instructs a copy sheet feed system when to feed a copy sheet towards a transfer station where the developed image formed on the photoconductive belt is transferred to the copy sheet so that the copy sheet will arrive at the transfer station at substantially the same time that the pitch containing the image from that document arrives at the transfer station. This scheduling process is performed for each document to be copied. Additionally, when the copy machine includes a recirculating document handler (RDH) or a universal document handler (UDH) that includes an RDH, the Job Manager also instructs the RDH when to feed a document from a set of documents, usually contained as a stack in a tray of the RDH, from the stack onto the platen for being imaged.

It is desirable to continuously feed documents from the stack of documents onto the platen so that each consecutive document is imaged onto a consecutive pitch of the photoconductive belt without skipping any pitches. When a pitch is skipped, a portion of the photoconductive belt which is large enough to receive a latent image of an original document is left blank (is not imaged) and thus is not fully utilized. These blank portions are also known as "skipped pitches". Skipped pitches decrease the speed at which a set of documents can be copied and also reduce the overall efficiency of the copy machine because the components of the copy machine experience wear-and-tear even if an image is not formed on a pitch (i.e., the belt continues to rotate even if no image is formed on a pitch). Thus, it is not desirable to skip pitches on the photoconductive belt.

It is also common for a document handler and copy machine to be used to copy documents having a variety of sizes (i.e., length-by-width sizes). Since the size of documents can vary, the amount of space required on the photoconductive belt to hold the latent image of a document (the size of the pitch) also varies. Thus, it is not uncommon for a copy machine to be operable in a number of modes of operation, each mode being for a different sized sheet, wherein the photoconductive belt has a different number of pitches depending on the size sheet to be imaged in that mode. For example, a copy machine may be operable in: a six pitch timing mode when it is imaging B5, A4, or 8½ inch wide documents; a five pitch timing mode when imaging B4 size documents; or a four pitch timing mode for imaging A3 and 11×17 inch documents. Obviously, the larger the size of the document to be imaged, the fewer number of pitches which are contained on the photoconductive belt.

In previous systems, the Job Manager or device which performed the scheduling of the various events to take place in the copy machine instructed each component of the copy machine when it was to perform its particular function for a particular document at the same time (usually shortly after the pitch which is to receive the latent image of a document passes a reference point). For example, the scheduling device would instruct: (a) the RDH when to begin feeding a document to the platen; (b) the imaging system when to begin imaging the document; and (c) the copy sheet feed system when to begin feeding a copy sheet towards the transfer station to receive the developed latent image of the document contained on the photoconductive belt, at the same time.

However, a problem arises in some copy machines due to the configuration of the RDH used therewith. This problem involves the detection of the last document in the set of documents. RDH's typically use an arm as an end-of-set detector, which is placed on top of the stack of documents prior to starting the imaging thereof, to determine when the last document in the stack of documents has been removed from the RDH. When the last document (which was the top document of the stack prior to starting the imaging) is removed from the RDH, the arm touches an electrical contact to provide a signal indicating the end of the set of documents. The location of the end of the set, and in particular, the knowledge that the last document in the set of documents is being fed through the copy machine is important for a number of reasons. For example, when a job involves making multiple copies of a set of documents, the end-of-set signal indicates the completion of each consecutive copy of that set of documents. This knowledge can be used to offset each copy of the set of documents. Additionally, the knowledge that the last document in the stack of documents is being fed through the copy machine is necessary when the last document in the stack of documents must be reproduced onto a special type of copy sheet. Usually the stack of documents is placed face-up in the RDH and the documents are fed from the bottom of the stack in N-1 order wherein the top document in the stack (and thus the last document to be fed through the RDH) is the cover sheet of the set of documents. It is frequently desired to have the cover sheet of a set of documents printed on a special type of paper (e.g., having a different stiffness, color, or other quality from the other copy sheets in the stack of documents). However, some RDH's have an end-of-set detector which is placed in a position, relative to the stack of documents and the direction which documents are removed from the stack, which does not always permit the removal of the last document from the stack of documents to be detected until after that last document has been scheduled by the Job Manager. In this situation, it was not possible for the image on that last document to be easily reproduced on a special type of copy sheet.

In some RDH's, such as RDH 100 illustrated in FIG. 1A, the removal of the last document of a stack of documents from the tray 104 which holds the stack is detected shortly after the last document begins to move from tray 104 regardless of the size of that document. RDH 100 includes a movable back wall 108 which moves in the directions indicated by arrow A and is set depending on the size of the documents being imaged, and a movable side wall 112 which moves in the direction of arrow B and is set depending on the length of the documents being imaged. Additionally, an end-of-set detector arm 116 is provided and attached within movable back wall 108 so as to be movable with back wall 108. Arm 116 is automatically placed on the top of the stack of documents prior to starting imaging of the stack of documents and touches contact 120 (located below tray 104) to provide an end-of-set signal shortly after the last document in the stack of documents is removed therefrom. The documents are removed from the stack in the direction of arrow C and placed on a platen located below RDH 100. As can be seen in FIG. 1A, the arm 116 will always touch contact 120 shortly after the last document begins moving from tray 104 because arm contacts the trailing edge of the documents as they are removed from tray 104.

However, RDH's having the arrangement illustrated in FIG. 1B operate somewhat differently. RDH 200 includes a tray 204, movable back wall 208 and movable side wall 212, similar to those shown in FIG. 1A. The end-of-set arm 216 and contact 220, however, are located at a fixed position near a side of tray 204 relative to the feed direction C. Since RDH 200 must be used with a variety of widely different sized documents, arms 216 and contact 220 must be located closely adjacent to a forward edge of tray 204 (relative to feed direction C) so that it can be used with sheets having a small width. Consequently, when RDH 200 is used with larger sized documents, arm 216 does not touch contact 220 until the last larger sized document is fed almost entirely out of tray 214. Depending on the type of copy machine used with RDH 200, the scheduling for the last document in the stack of documents will have been performed before the trailing edge of that last document passes arm 216, and thus the end-of-set signal will not be provided in time to place the correct type of copy sheet in the path which leads to the transfer station. In some machines, the scheduling of the imaging of a document must be performed very early during the process of removing the document from the tray 204 (i.e., prior to the time when the trailing edge of the document passes arm 216) so that the imaging system is ready to image that document as soon as it is placed on the platen, and so the next document can be fed to the platen immediately without skipping pitches. Since the scheduling of the copy sheet feed system is performed in previous copy machines at the same time as the scheduling of the imaging system, the copy sheet feed system was scheduled before the Job Manager could be provided with an end-of-set signal.

The above described problem has been addressed in the prior art as follows. Skipped pitches were placed between each document in the scheduling scheme so that adequate time was provided for detecting whether a document is the last document in the stack of documents. In this "skipped pitch" mode of operation, instead of scheduling the imaging system and the copy sheet feed system very early in the process of document removal from tray 204, the Job Manager waited one entire pitch until scheduling the imaging system and copy sheet feed system. By waiting one entire pitch, time was provided for the trailing edge of very large documents (e.g., 11×17" documents) to pass arm 216 so the Job Manager could receive the end-of-set signal. However, a pitch on the photoconductive belt (which continuously moves) had to be skipped between each document in the set in order for sufficient time to pass for the trailing edge of the last document to move past arm 216. Alternatively, the entire stack of documents was fed through the RDH without imaging thereof so that the number of documents in the set could be counted (this is known as precounting). Once the number of sheets in the stack was know, the Job Manager would automatically designate the correct type of copy sheet for receiving the image from the last document in the set of documents. The disadvantages of providing skipped pitches have been discussed above. Precounting has the disadvantages in that the total time required to image a stack of documents is increased. Depending on the size of the stack (or set) of documents, the precounting time can be sizable. The number of times which documents must be cycled through the RDH also increases the possibility of paper jams occurring.

U.S. Pat. No. 3,917,396 to Donohue et al. discloses a control system for controlling the processing steps of an electrostatic printing machine. The system includes a means for generating a series train of clock pulses, a means for generating a series train of start or reset pulses and control logic to generate a plurality of timed control signals used to implement processing steps.

U.S. Pat. No. 4,588,284 to Federico et al. discloses a control system which automatically alters control of a machine to respond to a different number of pitches or images. A pitch reset signal is generated by a paper handling remote control board. The reset signal is generated in response to a sensed registration finger. Specific processing steps such as development, cleaning, exposure, etc. are timed and controlled by the pitch reset signal and clock signals.

U.S. Pat. No. 4,800,482 to Hosaka et al. discloses a sequence controller for a copy machine which performs sequence timing control of electronic equipment in a predetermined order.

U.S. Pat. No. 4,816,868 to Shimizu et al. discloses an image forming apparatus in which copying operations are controlled according to a program sequence.

U.S. Pat. No. 4,589,645 to Tracy discloses a document set separator and stack height sensor which is used to provide an end-of-set signal.

Some examples of Xerox Corporation RDH U.S. Patents are U.S. Pat. No. 4,459,013 issued Jul. 10, 1984 to T. J. Hamlin et al.; U.S. Pat. No. 4,278,344 issued Jul. 14, 1981 to R. B. Sahay; and U.S. Pat. Nos. 4,579,444, 4,579,325 or 4,579,326. Some other examples of recirculating document handlers are disclosed in U.S. Pat. Nos. 4,076,408; 4,176,945; 4,428,667; 4,330,197; 4,466,733 and 4,544,148. A preferred vacuum corrugating feeder air knife, and a tray, for an RDH, are disclosed in U.S. Pat. Nos. 4,418,905 and 4,462,586. An integral semiautomatic and computer form feeder (SADH/CFF), which may be an integral part of an RDH, as noted in Col. 2, paragraph 2, therein, is disclosed in U.S. Pat. No. 4,462,527. Various other of these patents, such as U.S. Pat. No. 4,176,945 above, issued Dec. 4, 1979 to R. Holzhauser (Kodak) teach plural mode, e.g. RDH/SADH, document handlers.

As to control systems, some examples of various other prior art copiers with document handlers with control systems therefor, including document sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270; and 4,475,156. In an RDH, a document set separator conventionally counts document set recirculations by signaling each time the last document of the set is fed. See, e.g., U.S. Pat. No. 4,589,645. It is well known in general and preferable to program and execute document handler and copier control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either the provided verbal functional descriptions, such as those provided herein, or prior knowledge of those functions which are conventional, together with general knowledge in the software and computer arts. Controls may alternatively be provided utilizing various other known or suitable hardwired logic or switching systems.

All references cited in this specification, and their references, are incorporated by reference herein where appropriate for appropriate teachings of additional or alternative details, features, and/or technical background.

OBJECTS AND SUMMARY OF THE INVENTION

It is an object of the present invention to provide a copy machine which eliminates the need to use skipped pitches or to precount documents in a stack of documents to be imaged.

It is another object of the present invention to provide a control system for a copy machine which is able to perform all scheduling for copying a set of documents without skipping pitches or precounting even when the last document in the set is not determined until after the last document is scheduled for imaging.

It is a further object of the present invention to provide an improved method for scheduling documents and copy sheets in a copy machine which includes an end-of-set detector located along a forward portion of a side wall of an RDH used therewith.

To achieve the foregoing and other objects, and to overcome the shortcomings discussed above, a method of controlling a copy machine is provided wherein the scheduling of a copy sheet for being fed by a copy sheet feed system from a supply to a transfer station to have an image contained on an original document formed thereon is performed after that original document is scheduled for being imaged by an imaging system. Usually, the scheduling of the copy sheet feed system is delayed until the following pitch, and thus the scheduling of the copy sheet feed system occurs in a different pitch than the scheduling of the imaging system for a particular document. This delay permits the end-of-set signal to be generated if that document is the last document in a stack of documents to be copied prior to scheduling the copy sheet which is to receive a copy of the image contained on that last document. Thus, the control hierarchy of the copy machine is able to use the "knowledge" that a document is a last document in a set of documents to accurately control components of the copy machine (e.g., to select a proper type of copy sheet and/or offset copy sheet output) without skipping pitches or precounting the documents in the stack.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 2:
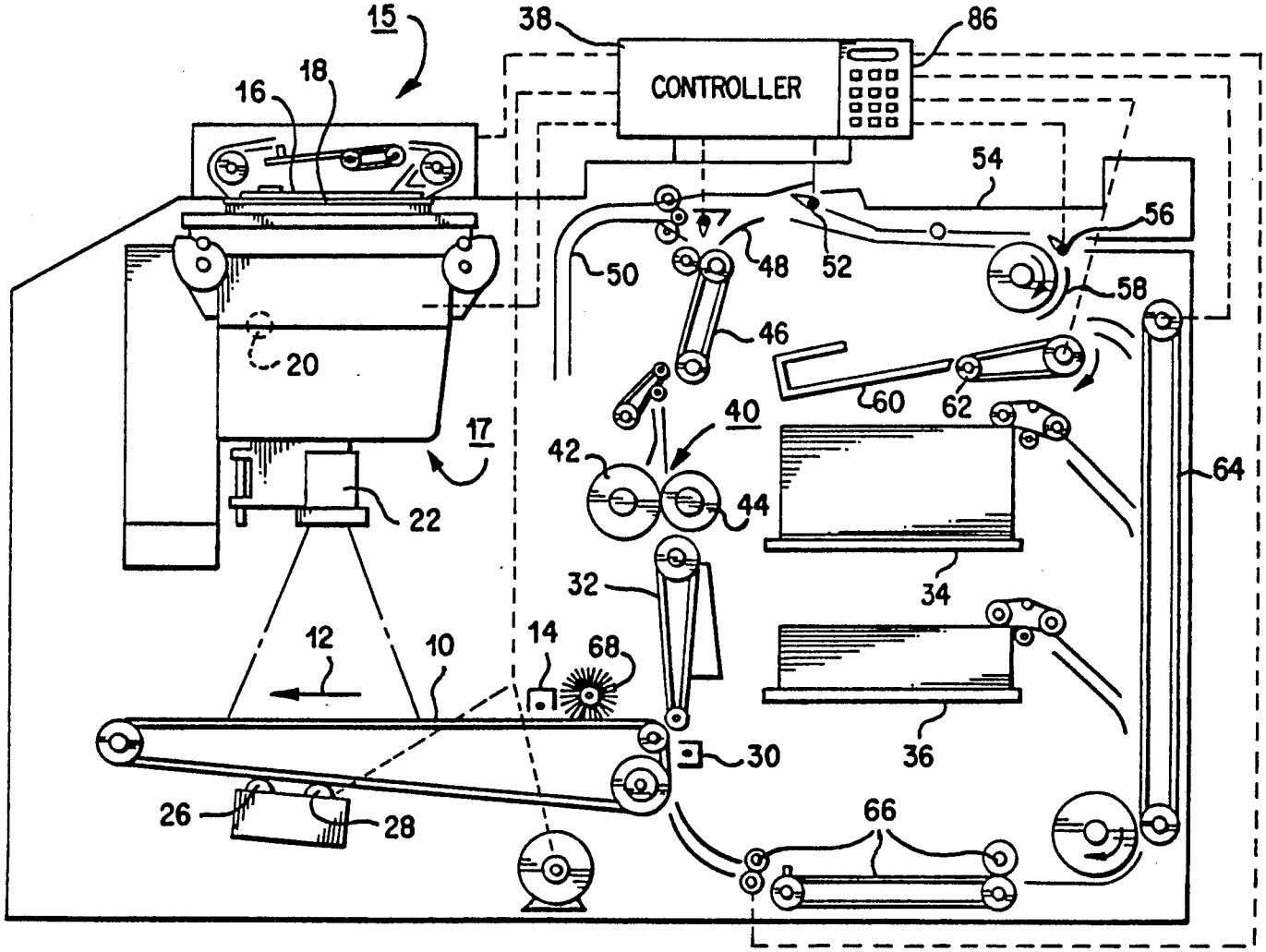
FIG. 2 is an elevational view of a copy machine typical of the type of machine or process that can be controlled in accordance with the present invention.

With reference to FIG. 2, there is shown an electrophotographic printing or copy machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charged portion of the photoconductive surface is then advanced through an imaging station. At the imaging station, a document handling unit (or document handler) 15 positions an original document 16 facedown over exposure system 17. The exposure system 17 includes lamp 20 illuminating the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge. This records an electrostatic latent image on the photoconductive surface corresponding to the informational areas contained within the original document.

Although the illustrated embodiment reflects light directly off of a document and onto photoconductive belt 10, it is understood that the present invention can also be used in copy machines which use other arrangements for imaging a document (i.e., forming a latent image of an original document on a photoconductive belt). For example, raster input scanning devices can be used to scan an image-containing surface of a document, to produce an electronic data signal representative of the image contained on the document. This data signal can then be used to control (or imagewise modulate) a laser beam which directs a beam of light towards a photoconductive belt to form a latent image thereon. For some examples of copy machines using the above-described type of scanner and/or laser printer, see U.S. Pat. Nos. 4,724,330 to Tuhro, 4,149,091, 4,864,415 to Beikirch et al., 4,903,079 to MacAndrew, and 4,647,981 to Froelich, the disclosures of which are herein incorporated by reference. Alternatively, a data signal can be used to modulate a stream of ions directed towards an electroreceptive surface to form a latent image thereon. For examples of copy machines using ion streams to form latent images on an electroreceptive belt, see U.S. Pat. Nos. 4,584,592 to Tuan et al., 4,646,163 to Tuan et al., 4,524,371 to Sheridon et al., 4,463,363 to Gundlach et al., 4,538,163 to Sheridon, 4,644,373 to Sheridan et al., and 4,737,805 to Weisfield et al., the disclosures of which are herein incorporated by reference.

Document handler 15 sequentially feeds documents from a holding tray, in seriatim, to platen 18. The document handling unit recirculates documents back to the stack supported on the tray. Thereafter, belt 10 advances the electrostatic latent image recorded on the photoconductive surface to a development station.

At the development station a pair of magnetic brush developer rollers 26 and 28 advance a developer material into contact with the electrostatic latent image. The latent image attracts toner particles from the carrier granules of the developer material to form a toner powder image on the photoconductive surface of belt 10. Other arrangements for applying toner onto belt 10 are, of course, possible.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the copy sheet.

The copy sheets are fed from a selected one of trays 34 or 36 to the transfer station. One of trays 34, 36 can contain a special type of copy sheet (i.e., cover sheets) or an additional tray (not shown) for holding special type sheets can be provided. After transfer, conveyor 32 advances the sheet to a fusing station. The fusing station includes a fuser assembly for permanently affixing the transferred powder image to the copy sheet. Preferably, fuser assembly 40 includes a heated fuser roller 42 and backup roller 44 with the sheet passing between fuser roller 42 and backup roller 44 with the powder image contacting fuser roller 42.

After fusing, conveyor 46 transports the sheets to gate 48 which functions as an inverter selector. Depending upon the position of gate 48, the copy sheets will either be deflected into a sheet inverter 50 or fed directly onto a second gate 52. Decision gate 52 deflects the sheet into a transport path which carries them on without inversion to a third gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60. Duplex tray 60 provides intermediate or buffer storage for those sheets which have been printed on one side for printing on the opposite side.

In order to complete duplex copying, the previously simplexed sheets in tray 60 are fed seriatim by bottom feeder 62 back to the transfer station for transfer of the toner powder image to the opposite side of the sheet. Conveyers 64 and 66 advance the sheet along a path which produces a sheet inversion. The duplex sheets are then fed through the same path as the previously simplexed sheets to be stacked in tray 54 for subsequent removal by the printing machine operator.

Invariably, after the copy sheet is separated from the photoconductive surface of belt 10, some residual particles remain adhering to belt 10. These residual particles are removed from the photoconductive surface thereof at a cleaning station. The cleaning station includes a rotatably mounted fibrous brush 68 in contact with the photoconductive surface of belt 10.

Figure 1A:
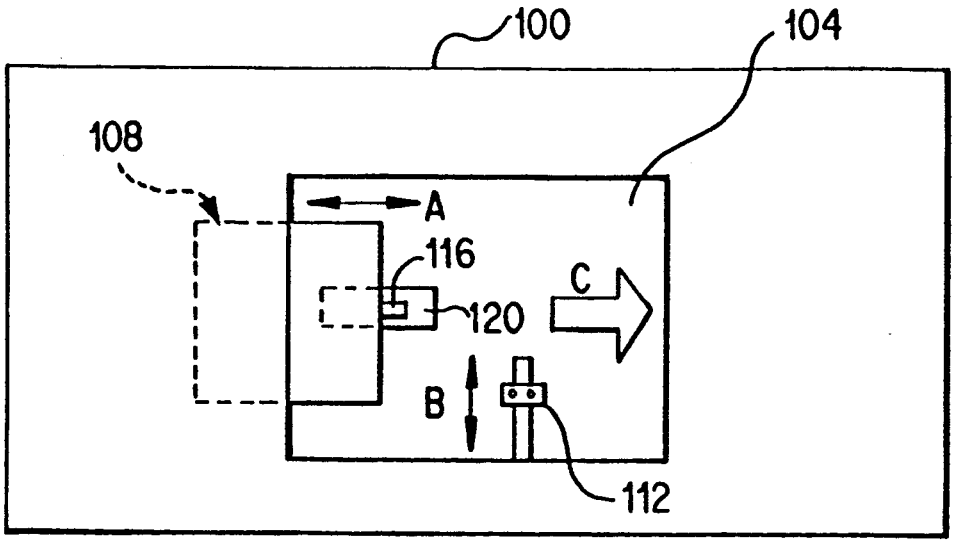
FIG. 1A PRIOR ART
FIGS. 1A and 1B are plan views of RDH's which have an end-of-set detecting arm located on a movable back wall and a fixed side wall, respectively.

A controller 38 and control panel 86 are also illustrated in FIG. 1. The controller 38, as represented by dotted lines, is electrically connected to the various components of the printing machine. All copier and document handling operations are preferably controlled by controller 38, which is a generally conventional programmable controller. It is additionally programmed with certain novel and unobvious functions described herein for the scheduling of events which are to take place in the copy process.

Controller 38 preferably comprises a known programmable microprocessor system, as exemplified by the above cited and other extensive prior art, e.g., U.S. Pat. No. 4,475,156 and its references. The controller 38 controls all of the machine steps and functions described herein, including all sheet (and document) feeding. This includes the actuations of the document and copy sheet feeders and inverters, gates, etc. As further taught in the references, controller 38 also conventionally provides for storage and comparison of the counts of the copy and document sheets, the number of documents fed and recirculated in a document set, the selection of a special type of copy sheet to receive the image from the last document in the set of documents, and other selections by the operator through connecting panel 86 of numerical and other control or function selection switches. Controller information and sheet path sensors are utilized to control and keep track of the positions of the respective documents and the copy sheets and the operative components of the apparatus by their connection to the controller. The controller may be conventionally connected to receive and act upon jam, timing, positional, and other control signals from various sheet sensors in the document recirculation paths and the copy sheet paths. The controller automatically actuates and regulates the positions of sheet path selection gates depending upon which mode of operation is selected and the status of copying in that mode. Controller 38 can also conventionally operate and change displays on control panel 86, which preferably includes operator selection buttons or switches.

Figure 1B:
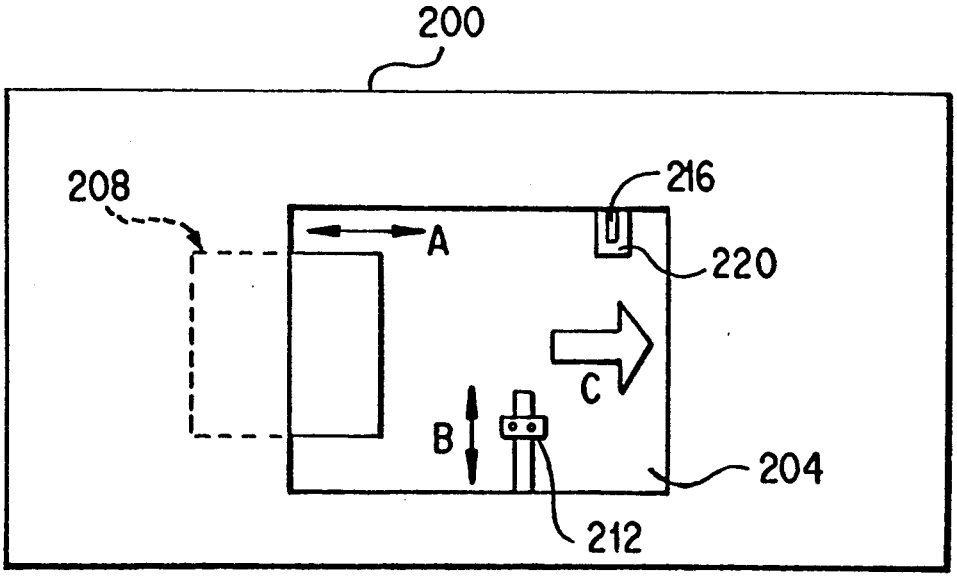
FIG. 1B PRIOR ART

A conventional document set separator in the RDH, such as, for example, arm 216 and switch 220 illustrated in FIG. 1B, and connected to controller 38, conventionally provides a signal indicating that the last document of the document set has been fed, i.e., a signal each time one complete document set circulation has been completed. See, for example, the above-incorporated U.S. Pat. No. 4,589,645.

Figure 3:
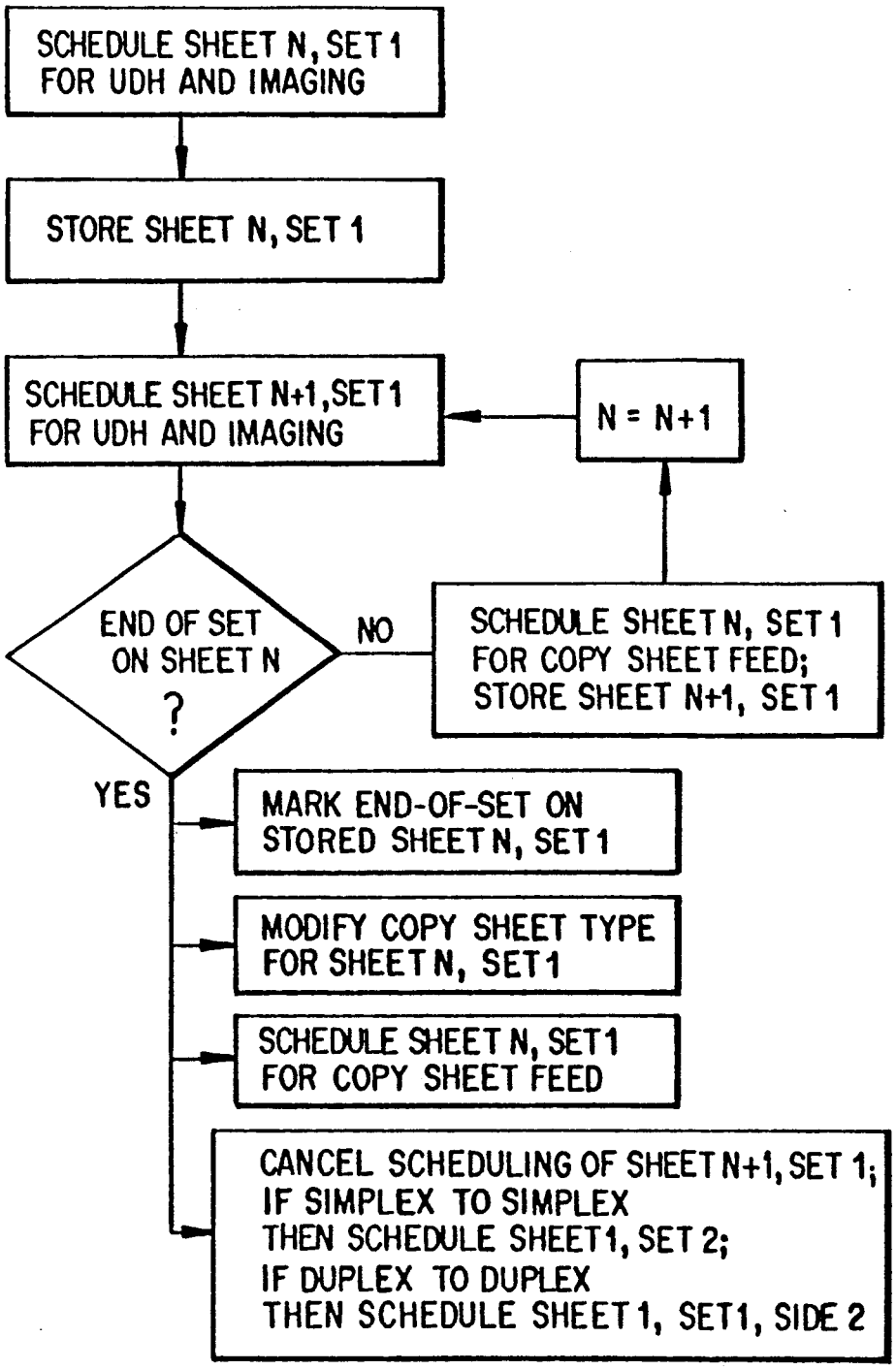
FIG. 3 is a schematic flow chart of one example of the disclosed cross-pitch scheduling system.

Turning now to the specific example of the system disclosed herein, there is disclosed, and illustrated in FIG. 3, a flow chart illustrating the steps to be performed by controller 38 in scheduling a document handler, imaging system and copy sheet feed system according to the present invention. The present invention permits a controller to schedule a document for feeding by a document handler onto a platen, for imaging by an imaging system of the copy machine so as to form a latent image of the document on a photoconductive belt, and for feeding of a copy sheet from a supply to a transfer station where the developed latent image on the photoconductive belt is transferred onto the copy sheet. In particular, the present invention permits a copy sheet to be scheduled while taking account of any special function that must be performed as a result of the detection of the last document in the set of documents being fed from the document handler, even if an end-of-set signal is not provided until after the document is scheduled for imaging. The present invention achieves this and other objects by scheduling the copy sheet feed system to feed a copy sheet for receiving an image from a document at some time after the imaging system has been scheduled to image that document.

The example illustrated in FIG. 3 is for a simplex-to-simplex copying job, and thus each document or copy sheet is indicated as having a paper number (e.g., document 1 or copy sheet 1) and a set number. Of course, it is understood that duplex sheets would also include a side number (e.g., 1 or 2) for each numbered document or copy sheet since each document or copy sheet would include an image on both sides thereof. Thus, although the flow chart illustrated in FIG. 3 primarily uses a simplex-to-simplex copy job as an example, it is also understood that with appropriate modifications which would be obvious to one of ordinary skill in the art from the presently provided description, the flow chart of FIG. 3 can also be used in a duplex-to-duplex job. The present invention is not needed for a simplex-to-duplex job because, in such a case, the controller will know the location of the last document in the stack of documents because it is necessary to precount the entire stack when imaging from simplex-to-duplex in N−1 order (to determine whether the number of sides to be imaged is even or odd). Alternatively, if imaging in 1−N order, the first sheet in the set of documents will be the front cover sheet and the present invention would apply to the Nth sheet for the back cover if necessary, Referring to the FIG. 3 flow chart, there is illustrated the following sequences or steps. Assuming that prior to performing a job, the value of variable N is initialized (N=1), a first sheet (designated as sheet N, set 1) is scheduled for being fed from the UDH (which includes an RDH) by, for example, providing a scheduling signal (more particularly, a document feed signal) to the document handler indicating when the document handler is to feed sheet N out of the tray of the document handler and onto the platen. At the same time, or shortly thereafter, the controller also schedules document N for imaging by the imaging system by, for example, sending an imaging signal (more particularly, an imaging start signal) to the imaging system indicating at what time the imaging system is to start imaging document N (which by that time will be properly located on the platen) to produce an image signal. This image signal is directed onto the photoconductive belt to form a latent image thereon. As stated earlier, the image signal can be, for example, light reflected from the document, a modulated light beam produced by a laser, or a modulated stream of ions. Due to the arrangement of the end-of-set detector (as discussed above), it is sometimes not possible to determine whether document N is the last document in the set of documents prior to the time when document N must be scheduled for imaging on the next available pitch of the photoconductive belt. While some previous systems waited an additional pitch until scheduling document N for imaging so that the end-of-set signal would be output and detected by the controller prior to scheduling the document for imaging (and prior to scheduling a copy sheet for being fed from a supply to receive the latent image of that document thereon), the present invention schedules document N for imaging on the next available pitch of the photoconductive belt and thus avoids skipping any pitches. However, as discussed earlier, it is impossible to accurately schedule a copy sheet for being fed from a supply towards the development station at the same time the imaging system is scheduled because the end of set detector will not have provided an end-of-set signal if document N is the last document in the set of documents.

Accordingly, the present invention does not schedule a copy sheet for being fed from a supply when the document whose image is to be formed on that copy sheet is scheduled for imaging. Instead, the need to schedule a copy sheet for receiving an image from document N is stored in memory until some time after the end-of-set signal is output by the end-of-set detector should document N be the last document in the set of documents. The particular information stored can include: side 1 or side 2, source tray, destination, type of copy stock (transparency, tab, etc.), sheet number, set number, and pitch width. However, before the controller can schedule a copy sheet for document N, the next document (document N+1) must be scheduled for feeding from the document handler and for imaging by the imaging system in order for the latent image of document N+1 to be formed on the immediately adjacent pitch on the photoconductive belt from the pitch containing the latent image of document N (i.e., in order to avoid skipped pitches). Consequently, before a copy sheet can be scheduled for document N, controller must first schedule document N+1 for being fed from the document handler to the platen and for being imaged by the imaging system. This is achieved by, for example, outputting a subsequent scheduling signal (more particularly, a subsequent vacuum and feed signal) to the document handler for feeding document N+1 onto the platen and outputting a subsequent scheduling signal (more particularly, a subsequent imaging start signal) to the imaging system indicating when the imaging system is to start imaging document N+1. Once again, a copy sheet (or subsequent copy sheet) which is to receive the image from document N+1 is not yet scheduled for being fed from the copy sheet supply.

Once document N+1 has been scheduled for being fed from the document handler and for being imaged by the imaging system, the controller will "know" whether document N was the last document in the set of documents because by this time, the controller will have received an end-of-set signal due to the complete feeding of document N out of the tray which holds the stack of documents, thus enabling an end-of-set detector arm (for example, arm 216) to touch an end-of-set contact (for example, contact 220). It should be noted that in the situation where document N is the last document in the set of documents, document N+1 does not really exist. Accordingly, the feeding of document N+1 from the document handler and the imaging of document N+1 by the imaging system must be canceled when document N is determined to be the last document in the set of documents. However, assuming that document N is not the last document in the set, the controller proceeds to schedule a copy sheet (copy sheet N) for being fed from a supply to receive the latent image corresponding to the image contained on document N. The need for scheduling a copy sheet to receive the latent image corresponding to the image contained on document N+1 is then stored in memory, and the value of N is incremented by 1. The routine then proceeds to schedule a further document for being fed from the document handler and for being imaged by the imaging system in a manner similar to that described above. The controller will continue to schedule the feeding of copy sheets to receive images contained on documents after subsequent documents have been scheduled for feeding by the document handler and for imaging by the imaging system until an end-of-set signal has been output for a document (document N in the flow chart of FIG. 3).

If necessary, the speed at which copy sheets are conveyed from their respective copy sheet supply trays (e.g., trays 34,36) to the transfer station to receive the toner image of a corresponding document can be increased to compensate for the delay in scheduling of the copy sheet feed system.

When an end-of-set signal is output, the controller performs a number of steps prior to repeating the copying of the set of documents if more than one copy of the set is desired. Document N is marked in memory as being the last document in the set of documents. Since the controller counts each document as it is removed from the document handler, the controller is able to know the number of the document which has been determined to be the last document in the set (for example, if N=30, document 30 is the last document in the set). Marking the appropriate document as the last document in the set is used by the controller for making subsequent copies of the set of documents. For example, when the next copy of the set of documents (set 2) is made, the scheduler will be able to correctly schedule the copy sheet to receive the image from the last document in the set without the output of the end-of-set detector because the controller will already "know" that this document (in the present example, the 30th document) is the last document in the set. At this time, the type of copy sheet which is to be fed by the copy sheet feed system is modified based upon data previously input by an operator. Such data includes, for example, data that the image contained on the last document of the set should be output on a special "cover" sheet which is contained in a different paper tray from the main stock and may be, for example, of a different thickness, material and/or color from the copy sheets which are to receive the images contained on the other documents in the set of documents. After appropriately modifying the type of copy sheet which is to be fed by the copy sheet feed system to receive the image contained on the last document in the set of documents, this copy sheet (copy sheet N) is scheduled for being fed by the copy sheet feed system from an appropriate supply to the transfer station. Accordingly, the present system is able copy sets of documents without skipping pitches or precounting while still using special cover sheets even if the hardware of the copy machine (for example, the document handler and the imaging system) must schedule a document for imaging prior to the time at which the document handler will detect whether that document is the last document in a set of documents. As stated earlier, the scheduling of sheet N+1 for being fed from the document handler and for imaging by the imaging system must be canceled. If an additional copy of the set is to be made, the scheduling of sheet N+1 would be cancelled, and the next sheet is denoted as sheet 1 of the next set (if simplex-to-simplex) or as sheet 1, set 1, side 2 (if duplex-to-duplex), with no loss of productivity.

Additionally, if simplex-to-simplex copying is being performed, the routine illustrated in FIG. 3 will then repeat itself for a second copy of the set (denoted as set 2) and will continue to increment the set number until the selected number of copies of the set of documents are produced. Alternatively, if the copy machine is operating to duplex-to-duplex mode, where the document handler must feed the set of documents onto the platen for imaging twice (once for each side of the document), the copy machine will at this time have imaged one side of each document and the document handler will have automatically inverted each document prior to being inserted back into the tray of the document handler. Accordingly, the controller will then control the copy machine so that the documents are fed onto the platen a second time so as to have the image contained on the opposite side of each document formed on the opposite side of each copy sheet which previously had the images contained on the first side of each document formed on one side thereof. The process of copying documents in duplex-to-duplex mode is well-known and thus no further explanation is provided.

Figure 4A:
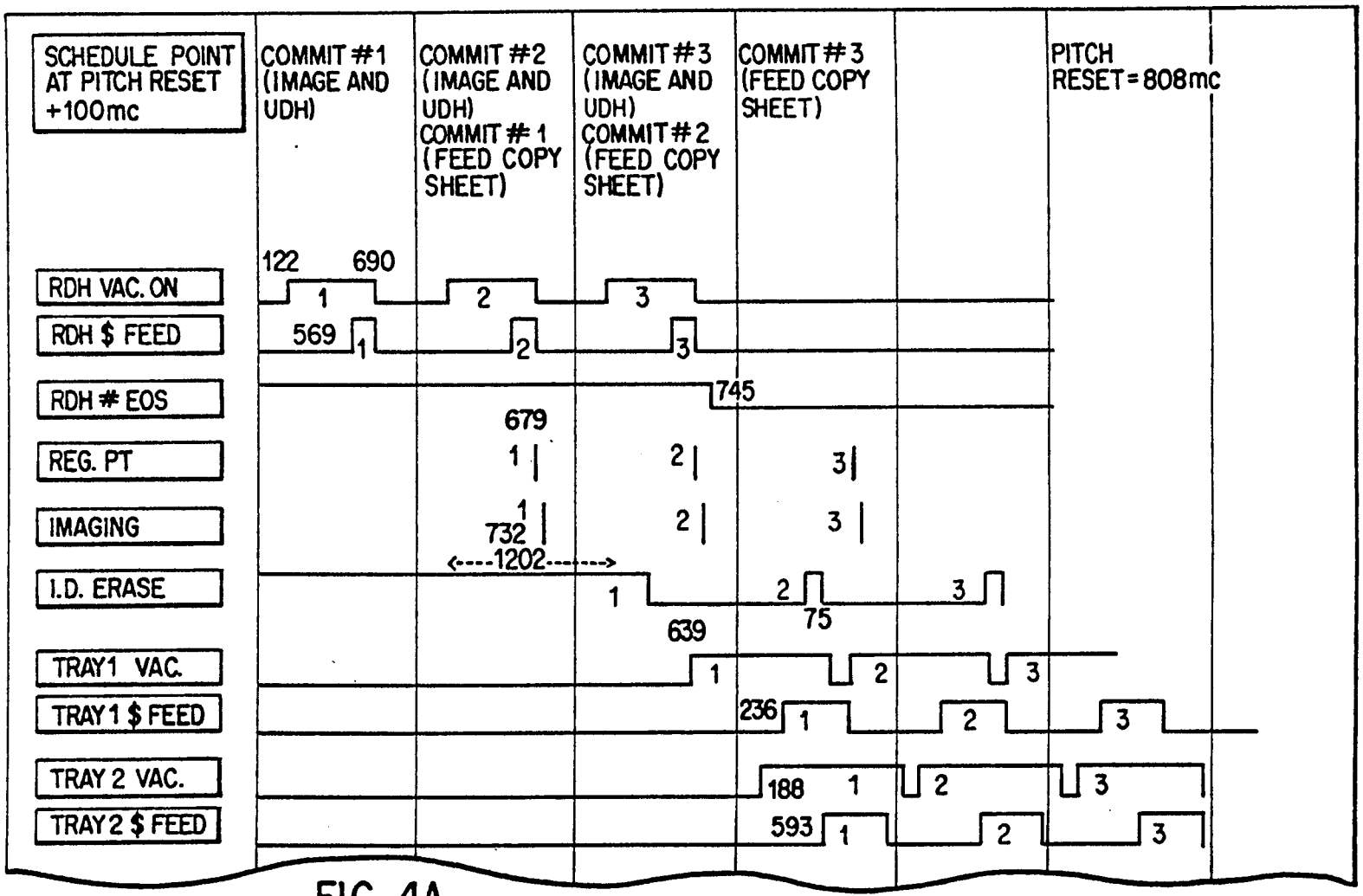
FIGS. 4A–6B are timing charts for 6, 5 and 4 pitch timing sequences, respectively.
Figure 4B:
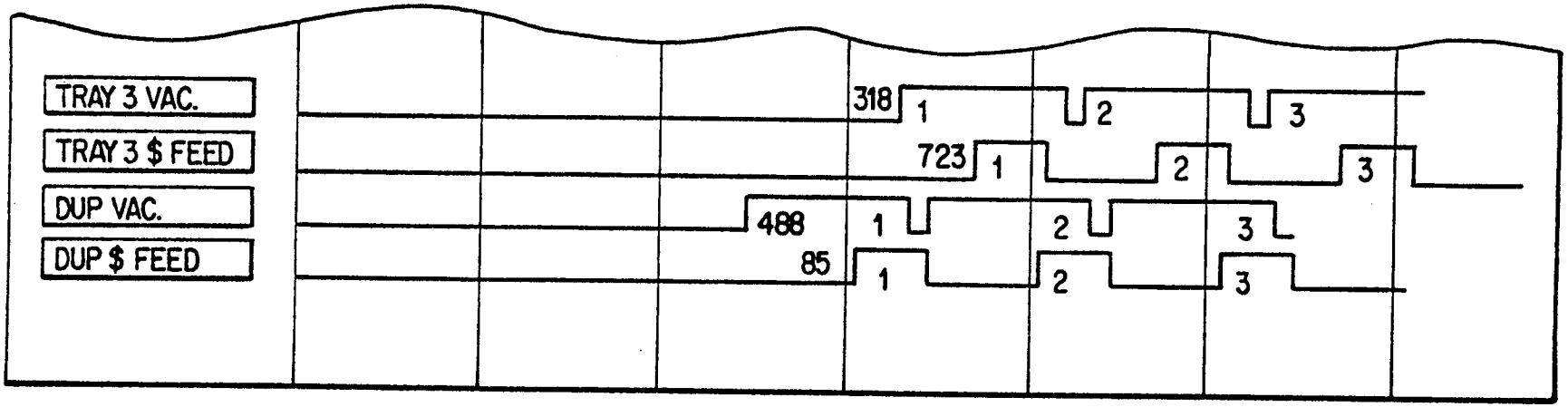
Figure 5A:
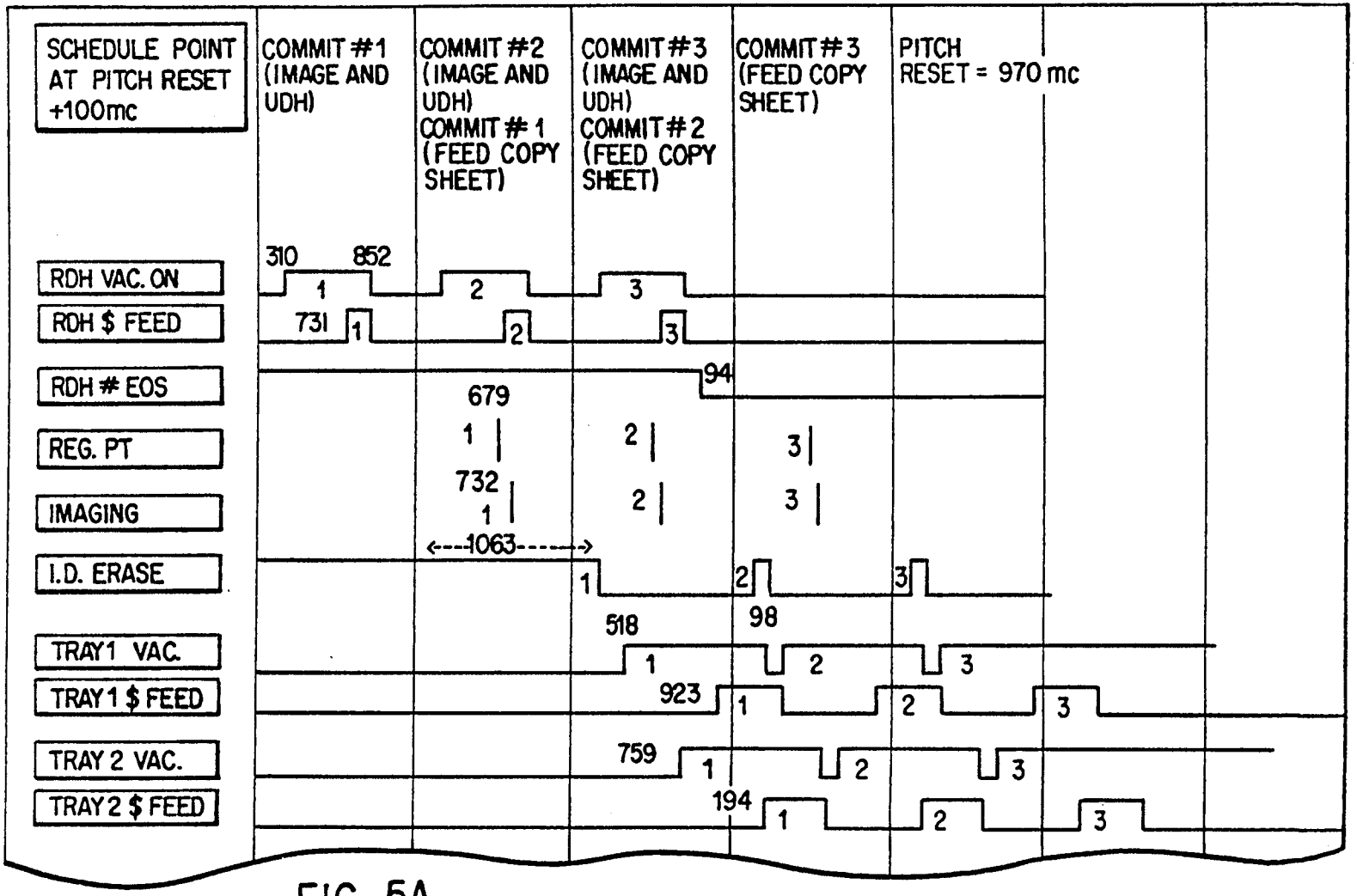
Figure 5B:
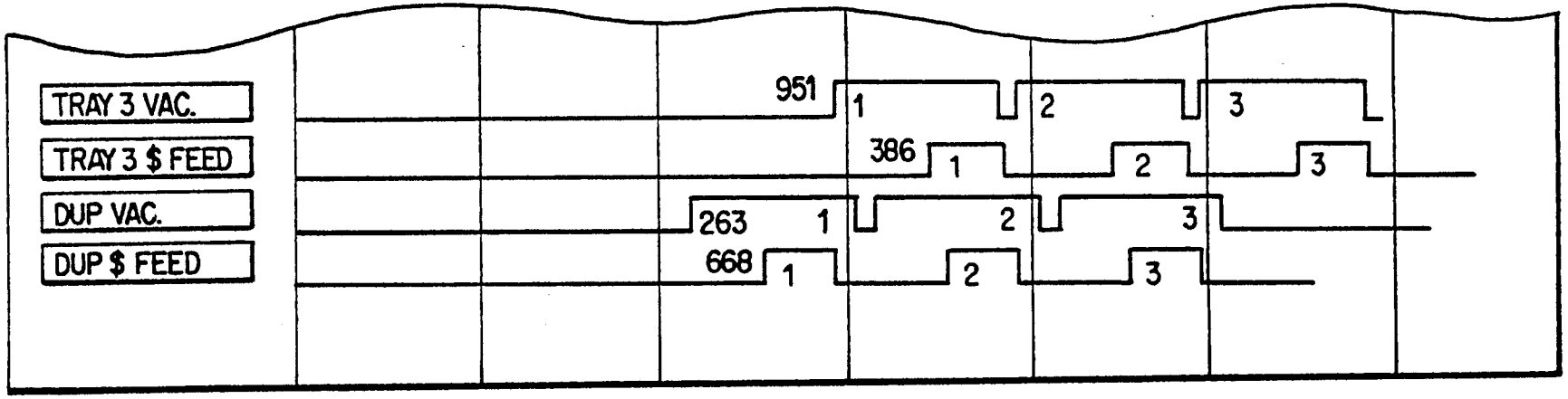
Figure 6A:
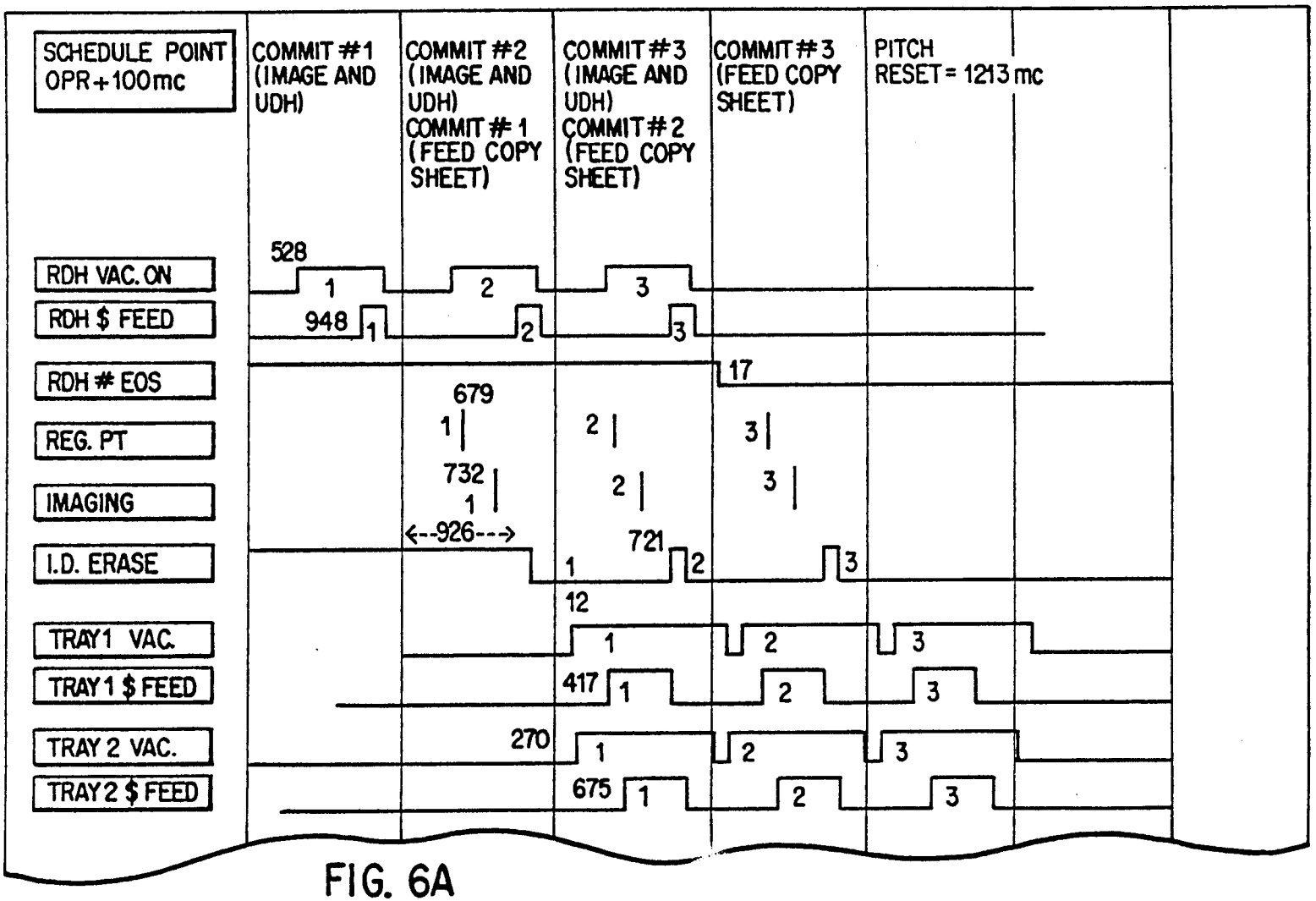
Figure 6B:
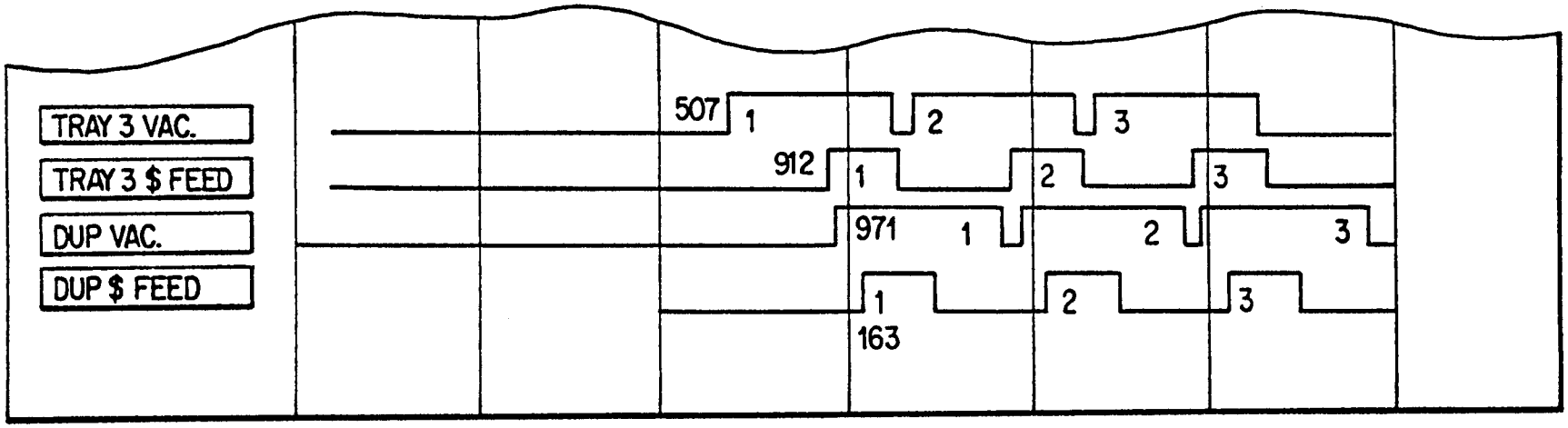

FIGS. 4A–6B are timing charts for 6, 5, and 4 pitch timing sequences, respectively. As stated earlier, the same photoconductive belt is used to copy documents having a variety of sizes and, thus, will have a variable number of pitches depending on the size of the documents to be copied. Accordingly, FIGS. 4A–B are a timing chart illustrating a sequence of events to be controlled by the controller in a mode of operation wherein the photoconductive belt is divided into six pitches. The photoconductive belt would be divided into six pitches when copying, for example, B5, A4 and 8½ inch wide sheets. FIGS. 5A–B are a timing chart illustrating a sequence of events to be controlled by the controller when the photoconductive belt is divided into five pitches when copying, for example, B4 size sheets. FIGS. 6A–B are a timing chart illustrating a sequence of events to be controlled by the controller when the photoconductive belt is divided into four pitches for copying, for example, A3 and 11×17″ sized sheets. Obviously, the number of pitches depend upon the size of the photoconductive belt and the size of the sheets to be copied. The examples illustrated in the timing charts of FIGS. 4A–6B are for sets of documents containing three documents. Each of the substantially horizontal lines having the shape of a square wave illustrates the placement and duration of events which are to be performed by the component of the copy machine listed on the left side of each corresponding substantially horizontal line. Each pulse in the substantially horizontal lines indicates which document (1, 2 or 3) for which the appropriate event is being performed. Each of the vertical lines which extend from the top to the bottom of each timing chart represents the time at which each consecutive pitch of the photoconductive belt passes a reference point. Accordingly, the duration of each pitch (denoted as the pitch reset) varies depending on the number of pitches into which the photoconductive belt is divided. The time (in milliseconds) when each event begins after the preceding pitch reset is also indicated for each event. All imaging functions (including I.D. Erase) are timed from the next pitch reset located after the original scheduling event to ensure consistency in timing. For example, referring to FIGS. 4A–B the I.D. Erase is illustrated as occurring approximately 1,202 milliseconds after the second illustrated pitch reset, although the scheduling of this event occurs before the second illustrated pitch reset. This technique is unrelated to the present invention and therefore is not discussed any further here.

As indicated on each timing chart, the controller schedules events approximately 100 milliseconds after each pitch passes the reference point. As denoted at the upper portion and to the right of each vertical line (which indicates a pitch reset point) is the word "Commit" and a number (indicating the number of a document or a copy sheet in the set) and a subsystem (in brackets) which is scheduled by the controller for the numbered document indicated. For example, in FIGS. 4A–B at the first pitch reset, the UDH and imaging systems must be scheduled by the controller for feeding and imaging document 1; at the second pitch reset, the UDH and imaging systems are scheduled for feeding and imaging of document 2 and the copy sheet feed system is scheduled for supplying a copy sheet for receiving the image from document 1. Thus it is seen that the scheduling of a copy sheet for a document is performed in a different pitch than the scheduling of the document handler and imaging system for the document whose image is to be formed on that copy sheet. Each timing chart illustrates the initiation and duration of each of the following events: turning on the vacuum in the RDH so as to more easily separate the documents in the set of documents from one another; the feeding of the lowermost document in the document handler tray out of the document handler tray and onto the platen; the output of the end of set signal by the RDH (this occurs only for the last document in the set); the point at which each document is properly located (registered) on the platen for imaging; imaging of a document; the time at which the I.D. Erase (Interdocument Erase Lamp) is actuated to discharge unused portions of the photoconductive belt; the time at which the vacuum is turned on and a copy sheet is fed from each of different copy sheet supply trays 1, 2 and 3; and the time at which the vacuum is turned on and a sheet is fed from the duplex tray 60 if duplex copying is being performed.

While the present invention is described with reference to a particular embodiment, this particular embodiment is intended to be illustrative, not limiting. For example, the present invention is applicable to copy machines which "image" documents using a scanner and modulated laser beam, or ionographic type devices. Various modifications may be made without departing from the spirit and scope of the invention as defined in the appended claims.

What is claimed is:

1. A method of controlling a copy machine having a platen for receiving documents to be copied, an imaging system, responsive to a scheduling signal, for imaging a document placed on the platen and producing a light image of the document, a photoreceptor for receiving the light image produced by said imaging system to form a latent image of the document thereon, developing means for toner developing said latent image on said photoreceptor, transferring means for transferring the toner developed latent image from the photoreceptor to a copy sheet, a copy sheet feed system, responsive to the scheduling signal, for consecutively supplying individual copy sheets from a supply to said transferring means, a document handler, responsive to the scheduling signal, for consecutively feeding individual documents from a set of documents to said platen, and control means for supplying the scheduling signal to said imaging system, said document handler, and said copy sheet feed system, said method comprising:

supplying the copy sheet feed system with a scheduling signal for one document, only after the imaging system and the document handler have been scheduled for said one document and for a next fed document to be fed from the document handler after said one document.

2. The method according to claim 1, wherein said document handler further comprises an end-of-set detector for supplying an end-of-set signal to said control means when a last document in the set of documents is conveyed out of said document handler, wherein said control means supplies said scheduling signal to said imaging system and said document handler for the last document in the set prior to receiving the end-of-set signal and supplies said scheduling signal to said copy sheet feed system after receiving the end-of-set signal.

3. The method according to claim 1, further comprising:

determining whether said one document is a last document in the set of documents after said imaging system and said document handler have been scheduled for said next fed document; and scheduling said copy sheet feed system for said one sheet and scheduling said imaging system and document handler for a further document to be fed from said document handler after said next fed document when said one sheet is determined not to be the last document in the set of documents; otherwise modifying a copy sheet type of copy sheet to be fed by said copy sheet feed system when a type of copy sheet to be used for the last document in the set differs from a type of copy sheet to be used for documents that are not the last document in the set; scheduling said copy sheet feed system for said one document; and canceling the scheduling of said next fed document for feeding by said document handler and imaging by said imaging system.

4. The method according to claim 3, further comprising:

storing in memory that said one document is the last document of said set.

5. A method of controlling a copy machine for copying a set of documents, said copy machine having a platen for receiving documents to be copied, a document handler for consecutively feeding individual documents of said set of documents to said platen, an imaging system for imaging documents as they are placed on said platen to produce an image signal representative of images contained on said documents, said image signal being used to form an output image which corresponds to the image contained on said document on a copy sheet at a transfer station, a copy sheet feed system for consecutively supplying individual copy sheets from a supply to said transfer station, and control means for controlling the document handler, imaging system and copy sheet feed system, said control means sending: a document feed signal to said document handler indicating when said document handler is to feed a next document to said platen; an imaging start signal to said imaging system indicating when said imaging system is to start imaging said next document so as to produce said image signal; and a copy sheet supply signal to said copy sheet feed system indicating when said copy sheet feed system is to begin feeding a copy sheet to said transfer station; said method comprising:

sending a copy sheet supply signal for one document to said copy sheet feed system, only after a document feed signal and an imaging start signal for a next fed document are supplied to said document handler and said imaging system, respectively.

6. The method according to claim 5, wherein said document handler further comprises an end-of-set detector for supplying an end-of-set signal to said control means when a last document in the set of documents is conveyed out of said document handler, wherein said control means sends said document feed signal and said imaging start signal to said document handler and said imaging system, respectively, for the last document in the set prior to receiving the end-of-set signal and supplies said copy sheet supply signal to said copy sheet feeding system after receiving the end-of-set signal.

7. The method according to claim 5, further comprising:

determining whether said one document is a last document in a set of documents after said document handler and said imaging system having been scheduled for said next fed document; and scheduling said copy sheet feed system for said one sheet and scheduling said document handler and said imaging system for a further document to be fed from said document handler after said next fed document when said one sheet is determined not to be the last document in the set of documents; otherwise modifying a copy sheet type of copy sheet to be fed by said copy sheet feed system if a type of copy sheet to be used for the last document in the set differs from a type of copy sheet to be used for documents that are not the last document in the set, scheduling said copy sheet feed system for said one copy sheet; and canceling the scheduling of said document handler and said imaging system for said next fed document.

8. The method according to claim 7, further comprising:

storing in memory that said one document is the last document of said set.

9. A method of controlling a copy machine for copying a set of documents, said copy machine having a platen for receiving documents to be copied, a document handler for consecutively feeding individual documents from said set of documents to said platen, an imaging system for imaging documents placed on said platen to produce an image signal representative of images contained on said documents, said image signal being used to form an output image, which corresponds to the image contained on a document, on a copy sheet at a transfer station, and a copy sheet feed system for consecutively supplying individual copy sheets from a supply to said transfer station to have the output image formed thereon, said method comprising:

scheduling one document for being fed by said document handler from said set onto said platen at a first time relative to a reference time;

scheduling said one document for being imaged by said imaging system at a second time relative to said reference time, so as to produce an image signal representative of images contained on said one document;

scheduling a subsequent document for being fed by said document handler from said set onto said platen at a third time relative to said reference time;

scheduling said subsequent document for being imaged by said imaging system at a fourth time relative to said reference time so as to produce an image signal representative of images contained on said subsequent document; and scheduling one copy sheet for being supplied by said copy sheet feed system from said supply to said development station at a fifth time relative to said reference time so as to receive the image signal representative of images contained on said one document;

wherein the scheduling of said one copy sheet is performed after the scheduling of said subsequent document for being fed by said document handler and for being imaged by said imaging system.

10. The method according to claim 9, further comprising:

determining whether said one document is a last document in said set after said subsequent document is scheduled for being fed and being imaged; and scheduling said one copy sheet for being supplied by said copy sheet feed system from said supply to said transfer station, scheduling a further document for being fed by said document handler from said set onto said platen at a sixth time relative to said reference time, and scheduling said further document for being imaged by said imaging system at a seventh time relative to said reference time if said one document is determined not to be the last document in the set; otherwise modifying a copy sheet type of copy sheet to be fed by said copy sheet feed system if a type of copy sheet to be used for the last document in the set differs from a type of copy sheet to be used for documents which are not the last document, scheduling said one copy sheet for being supplied by said copy sheet feed system, and canceling the feeding of said subsequent document by said document handler and the imaging of said subsequent document by said imaging system.

* * * * *